United States Patent [19]

Bromley

[11] 4,391,444

[45] Jul. 5, 1983

[54] ELECTRONIC GAME PROVIDING FORMATION CHANGES AND METHOD

[75] Inventor: Eric Bromley, West Simsbury, Conn.

[73] Assignee: Coleco Industries, Inc., Hartford, Conn.

[21] Appl. No.: 232,808

[22] Filed: Feb. 9, 1981

[51] Int. Cl.[3] ..... A63F 9/00

[52] U.S. Cl. ..... 273/94; 273/85 G

[58] Field of Search ..... 273/1 E, 1 GC, 85 G, 273/88, 94, DIG. 28, 313

[56] References Cited

U.S. PATENT DOCUMENTS

| | | | |
|---|---|---|---|
| 2,471,841 | 5/1949 | Sells | 200/6 |
| 2,589,025 | 3/1952 | Phelps et al. | 200/16 |
| 3,005,055 | 10/1961 | Mattke | 179/90 |
| 3,223,792 | 12/1965 | Strother | 200/6 |
| 3,874,669 | 4/1975 | Ariano et al. | 273/DIG. 28 |
| 4,026,048 | 5/1977 | Hill et al. | 37/42 R |
| 4,026,555 | 5/1977 | Kirschner et al. | 273/DIG. 28 |
| 4,027,119 | 5/1977 | Tezuka | 200/6 |
| 4,029,915 | 6/1977 | Ojima | 200/5 A |
| 4,041,258 | 8/1977 | Harada | 200/6 A |
| 4,095,791 | 6/1978 | Smith et al. | 273/DIG. 28 |
| 4,124,787 | 11/1978 | Aamoth et al. | 200/6 A |
| 4,142,180 | 2/1979 | Burson | 340/709 |
| 4,171,470 | 10/1979 | Gettig | 200/6 A |
| 4,218,702 | 8/1980 | Brocard et al. | 358/109 |
| 4,230,916 | 10/1980 | Mochizuki | 200/6 |
| 4,246,452 | 1/1981 | Chandler . | |
| 4,249,734 | 2/1981 | Bromley | 273/94 |
| 4,249,735 | 2/1981 | Bromley | 273/94 |

FOREIGN PATENT DOCUMENTS

| | | | |
|---|---|---|---|
| 810733 | 5/1974 | Belgium . | |
| 2408027 | 5/1975 | Fed. Rep. of Germany . | |
| 2807231 | 8/1978 | Fed. Rep. of Germany . | |
| 2826731 | 12/1978 | Fed. Rep. of Germany . | |
| 7414327 | 5/1976 | Netherlands . | |
| 2000946 | 1/1979 | United Kingdom | 273/DIG. 28 |

OTHER PUBLICATIONS

*"Electronic Sea Battle Game From the Mego Corporation"*, Playthings Magazine, Apr. 1979, p. 28.

*Primary Examiner*—Vance Y. Hum

*Assistant Examiner*—Leo P. Picard

[57] ABSTRACT

An electronic football game has a housing on which are provided a central simulated playing field and a separate control panel on each of two sides of the simulated playing field. In each control panel are provided two vertically elongated levers, each of which is operable to selectively operate four switches that direct the movements of a set of play symbols associated with the lever. Operation of one of the levers moves a plurality of concurrently movable play symbols as a group, but if one of the concurrently movable play symbols is directed into a boundary or another offensive play symbol, the move of that player is prevented while the moves of the other concurrently movable symbols are carried out. Upon a subsequent directed move that is not beyond a boundary or to the position of another offensive play symbol, the moves of all of the concurrently movable plurality are effected, and the new formation resulting from the earlier prevented move is thereby maintained.

32 Claims, 20 Drawing Figures

ELECTRONIC GAME PROVIDING FORMATION CHANGES AND METHOD

BACKGROUND OF THE INVENTION

The present invention is directed to electronic games, particularly those of the type in which simulated sports action is provided by selective actuation of discrete visual-image-producing devices in a matrix of such devices arrayed about a simulated playing field.

Electronic games of the type that employ a matrix of discrete visual-image-producing devices to provide the same action have enjoyed considerable success in recent years. This success has understandably inspired a large variety of efforts to produce such games. Efforts have been directed both at simulating different types of games and also at improving existing simulations.

In order to provide an interesting game, it is desirable that the number of possible play situations be large. The game designer will therefore want to provide the operator with control over a significant number of play symbols. A competing consideration, however, is that the simulated players over which the operator has control must be provided in such a way that he can reasonably control the movements of all or most of them simultaneously in real time; an increase in the number of play symbols that are theoretically controllable by operation of keys on a control panel does not significantly increase the play value of the same if the number that the operator can realistically control at a time is not increased.

An arrangement for increasing the number of player symbols over which the operator has control without significantly increasing the difficulty of controlling them is illustrated in U.S. Pat. No. 4,249,735, granted Feb. 10, 1981, to Eric Bromley for an "Electronic Simulated Football Game and Method." The game illustrated in that application provided a set of play symbols that were movable as a group by depression of a single key; a key directing the movement of one of them one step forward; for instance, would ordinarily cause all of them to move one step forward.

A further increase in the possibilities presented is provided in a game, currently, being marketed under a number of names, in which the offensive operator is provided with four offensive play symbols, three of which move concurrently as in the Bromley application and a fourth of which moves separately. By operation of an extra switch on the control panel, the control ordinarily afforded by the direction buttons over the three concurrently movable play symbols can be applied to the separate symbols.

It is an object of one aspect of the present invention to permit the operator to effectively control independently movable play symbols simultaneously. It is an object of another aspect to afford greater control over the relative positions of the concurrently movable symbol.

SUMMARY OF THE INVENTION

The foregoing and related objects are achieved in an electronic apparatus for simulating a sports-action team game. The apparatus includes a housing and a display panel on the upper surface of the housing that provides a visual simulation of a playing field of the type on which a ball-type game is played. The display panel is adapted to display symbols in and between side and end boundary positions on the field in response to electrical signals applied to it. An operational-circuit means in the housing is operatively connected to the display panel for generation and transmission of electrical signals to the display panel to produce offensive and defensive play symbols on the simulated playing field. One of the offensive play symbols at a time simulates the position of the ball.

The operational-circuit means includes means for moving a multiplicity of the offensive play symbols, including the ball-position symbol, along the playing field. The multiplicity of offensive play symbols includes a concurrently movable plurality thereof. Means for moving a multiplicity of the defensive play symbols along the playing field toward the ball-position symbol is also provided. Movement of the offensive and defensive play symbols provides play action simulating the action of the sports-action team game. Means for detecting the coincidence of the ball-position symbol with at least a selected one of the defensive play symbols during at least a portion of a play terminates play action upon such detection to simulate a "tackle." The operational circuit means also includes means for monitoring the position of at least one of the concurrently movable plurality of offensive play symbols, assigning prohibited moves to the symbol based on its monitored position on the playing field, and preventing the prohibited moves of the at least one offensive play symbol by the offensive-play-symbol-movement means. Additionally, it provides means for monitoring play action to record information concerning the status of the simulated game and for producing signals indicative of the status information. The signals convey the recorded information to an operator of the game.

Finally, the apparatus includes a control board on the housing that includes a multiplicity of manually operable control elements. The control board is connected to the operational-circuit means for transmission of signals to it through operation of the control elements. The offensive-play-symbol-movement means effects movement of the ball-position symbol in response to operation of the control elements by the operator to effect movement of the ball-position symbol through the defensive play symbols to simulate advance of the ball, and play action is terminated by the detecting means upon the occurrence of a simulated "tackle".

At least one of the manually operable control elements transmits signals to the operational-circuit means to direct moves of the concurrently movable plurality of offensive play symbols. Its operation to direct a move of the concurrently movable plurality of offensive play symbols causes the same move in each concurrently movable offensive play symbol whose directed move is not prohibited, but any offensive symbol of the concurrently movable plurality whose move is prohibited remains stationary during the movement of the others of the concurrently movable plurality. The formation defined by the relative positions of the concurrently movable plurality is thereby changed. The symbol whose move was prohibited again moves with the other offensive play symbols of the concurrently movable plurality upon the next directed move that is not prohibited, so an original formation can be changed and the new formation maintained by first directing a move that is prohibited to at least one but not all of the concurrently movable plurality and then directing a move that is not prohibited to any of the concurrently movable plurality.

Preferably, the concurrently movable plurality of offensive play symbols includes the ball-position symbol, and the prohibited moves assigned by the means for assigning prohibited moves include moves to a position occupied by any other offensive play symbol of the concurrently movable plurality. In the illustrated embodiment, the means for assigning prohibited moves monitors the positions of more than one of the concurrently movable plurality of offensive play symbols, assigns prohibited moves to them based on their monitored positions along the playing field, and prevents the prohibited moves. Specifically, it monitors the positions of all of the concurrently movable plurality of offensive play symbols, assigns prohibited moves to them based on their monitored positions along the playing field, and prevents the prohibited moves.

A particularly versatile arrangement results if the prohibited moves assigned by the means for assigning prohibited moves include moves to the position occupied by at least one symbol separate from the concurrently movable plurality. In the illustrated embodiment the separate symbol is one of the multiplicity of offensive play symbols, and at least one of the manually operable control elements transmits signals to the operational-circuit means to direct movements of the separate symbol to move it independently of the concurrently movable plurality of offensive play symbols. The offensive-play-symbol-movement means includes means for advancing the ball-position symbol independently of the other offensive play symbols of the concurrently movable plurality in a linear path along the simulated playing field to simulate a ball being passed, the means for assigning prohibited moves permits coincidence of the ball-position symbol with at least the separate offensive play symbol during a simulated pass, and the operational-circuit means further includes means for detecting the coincidence of the ball-position symbol and the separate offensive play symbol during a simulated pass to detect a simulated reception. The separate offensive play symbol thereby simulates a pass "receiver."

The prohibited moves assigned by the means for assigning prohibited moves ordinarily include moves beyond the side boundary positions.

The at least one manually operable control element for directing movements of the separate offensive play symbol is, in the illustrated embodiment, different from the at least one manually operable control element for directing movements of the concurrently movable plurality of offensive play symbols, and the elements are operable simultaneously to provide simultaneous manually controlled movement of the concurrently movable offensive play symbols and the separate offensive play symbol.

The moves prevented by the means for assigning prohibited moves may also include moves beyond the boundary positions at one of the ends.

By providing an apparatus with a number of the features described above, it is possible to practice the method described below for simulating a sports-action team game. The method includes the step of monitoring the position of at least one of the concurrently movable plurality of offensive play symbols and assigning prohibited moves to it based on its monitored position on the playing field. At least one of the manually operable control elements is operated to transmit signals to the operational-circuit means to direct the same move to each of the concurrently movable plurality of offensive play symbols, this move being prohibited to at least one of the concurrently movable plurality. All of the directed moves of the concurrently movable plurality are effected except the at least one prohibited move, so the formation defined by the relative positions of the concurrently movable plurality is changed.

At least one of the manually operable control elements is then operated again to transmit signals to the operational-circuit means to direct a move of the concurrently movable plurality of offensive play symbols, but this directed move is not prohibited to any of them. Finally, the last-mentioned directed moves of all of the concurrently movable plurality are effected, so the new formation resulting from the first-mentioned effected moves is maintained.

It is also possible to practice a method that includes arranging the concurrently movable plurality of offensive play symbols with at least one but not all of the concurrently movable plurality in one of the side and end boundary positions. At least one of the manually operable control elements is operated to transmit signals to the operational-circuit means to direct all the concurrently movable plurality of play symbols in the direction of the one of the end and side boundary positions so that the at least one offensive play symbol is directed to move beyond the one of the end and side boundary positions. The directed moves of all of the concurrently movable offensive play symbols except the at least one in the one of the side and end boundary positions are effected, so the formation defined by the relative positions of the concurrently movable plurality of offensive play symbols is changed to a new formation. The manually operable control elements are then operated again, this time to transmit signals to the operational-circuit means to direct the same move of all of the concurrently movable plurality of offensive play symbols away from the one of the side and end boundary positions. These moves are all effected, and the new formation is thereby maintained.

When the apparatus is so provided there is at least one independent offensive play symbol in addition to the concurrently movable plurality, a method may be practiced that includes the step of arranging the offensive play symbols with the independent offensive play symbol adjacent at least one of the concurrently movable offensive play symbols. At least one of the manually operable control elements is operated to transmit signals to the operational-circuit means to direct the same move to all of the concurrently movable plurality of offensive play symbols. The directed move includes a move to the position of the independent offensive play symbol of the concurrently movable offensive play symbol adjacent the independent offensive play symbol. The directed moves of all of the offensive play symbols except the at least one adjacent the independent offensive play symbol are effected, so a new formation defined by the relative positions of the concurrently movable plurality of offensive play symbols is provided.

At least one of the manually operable control elements is again operated, this time to transmit signals to the operational-circuit means to direct the concurrently movable plurality of offensive play symbols so that none of the directed moves is to the position of the independent offensive play symbol. These last-mentioned directed moves of all of the concurrently movable plurality of offensive play symbols are then effected, so the new formation is maintained.

Certain objects of the present invention are achieved in such an apparatus when the a display panel has a multiplicity of discrete visual-image-producing devices arranged along x- and y-axes of the simulated playing field and adapted to display symbols representing players of opposing teams at a multiplicity of discrete positions along the x- and y-axes on the playing field in response to electrical signals. The control elements should include first and second elongated levers, respectively, associated with the first and second symbols, the levers being pivotably mounted in the control board for pivoting from rest positions in which the longitudinal axes of the levers extend generally perpendicularly to the upper surface of the housing. The pivoting is along two pivotal axes extending generally perpendicularly to the longitudinal axes of the levers. The control board further includes at least three switches associated with each of the levers along the pivotal axes and electrically connected to the operational-circuit means for transmission of electrical signals to it to direct movements of the symbol associated with each of the levers. Pivoting of each of the levers along one pivotal axis in first and second directions operates the associated first and second switches to direct motion of the associated symbol in first and second directions, respectively, along one axis of the simulated playing field. Pivoting of each of the levers in a first direction along its second pivotal axis operates the associated third switch to direct motion of the associated symbol in a first direction along the other of the axes of the playing field. Each actuation of a switch causes only one step of motion of the associated symbol. Each lever and its associated switches are cooperatively configured and dimensioned, and each lever is pivotably mounted, so as to permit operation of only one switch at a time by each lever.

In the illustrated embodiment, the operational-circuit means also generates and transmits electrical signals to one display panel to produce first and second symbols of the other team on the simulated playing field. There is included a second control board on the housing including a multiplicity of manually operable control elements, and the second control board also is electrically connected to the operational-circuit means for transmission of signals to it through operation of the control elements of the second control board. The control elements include first and second elongated levers, respectively, associated with the first and second symbols of the other team. The levers of the second control board are pivotably mounted in the second control board for pivoting from rest positions. In the rest position, their longitudinal axes extend generally perpendicularly to the upper surface of the housing, and the pivoting is along two pivotal axes extending generally perpendicularly to the longitudinal axes of the levers. The second control board further includes at least three switches associated with each of its levers along the pivotal axes. The switches are electrically connected to the operational-circuit means for transmission of electrical signals to it to direct movements of the symbols associated with the levers of the second control board. Pivoting of each of the levers of the second control board along one pivotal axis in first and second directions operates its associated first and second switches to direct motion of the associated symbol in first and second directions, respectively, along the one axis of the simulated playing field. Pivoting of each of the levers in a first direction along its second pivotal axis operates its associated third switch to direct motion of its associated symbol in a first direction along the other axis of the playing field. Each actuation of a switch causes only one step of motion of the associated symbol. The switches and levers are cooperatively configured and dimensioned, and the levers are pivotably mounted, so as to permit operation of only one switch at a time by each lever.

There may also be a fourth switch associated with each lever. Pivoting of each in a second direction along its second pivotal axis operates the associated fourth switch to direct motion of the associated symbol in a second direction along the other axis of the playing field.

BRIEF DESCRIPTION OF THE DRAWINGS

These and other features and advantages of the present invention are described with reference to the accompanying drawings, in which.

DETAILED DESCRIPTION OF THE PREFERRED EMBODIMENT

Figure 1:
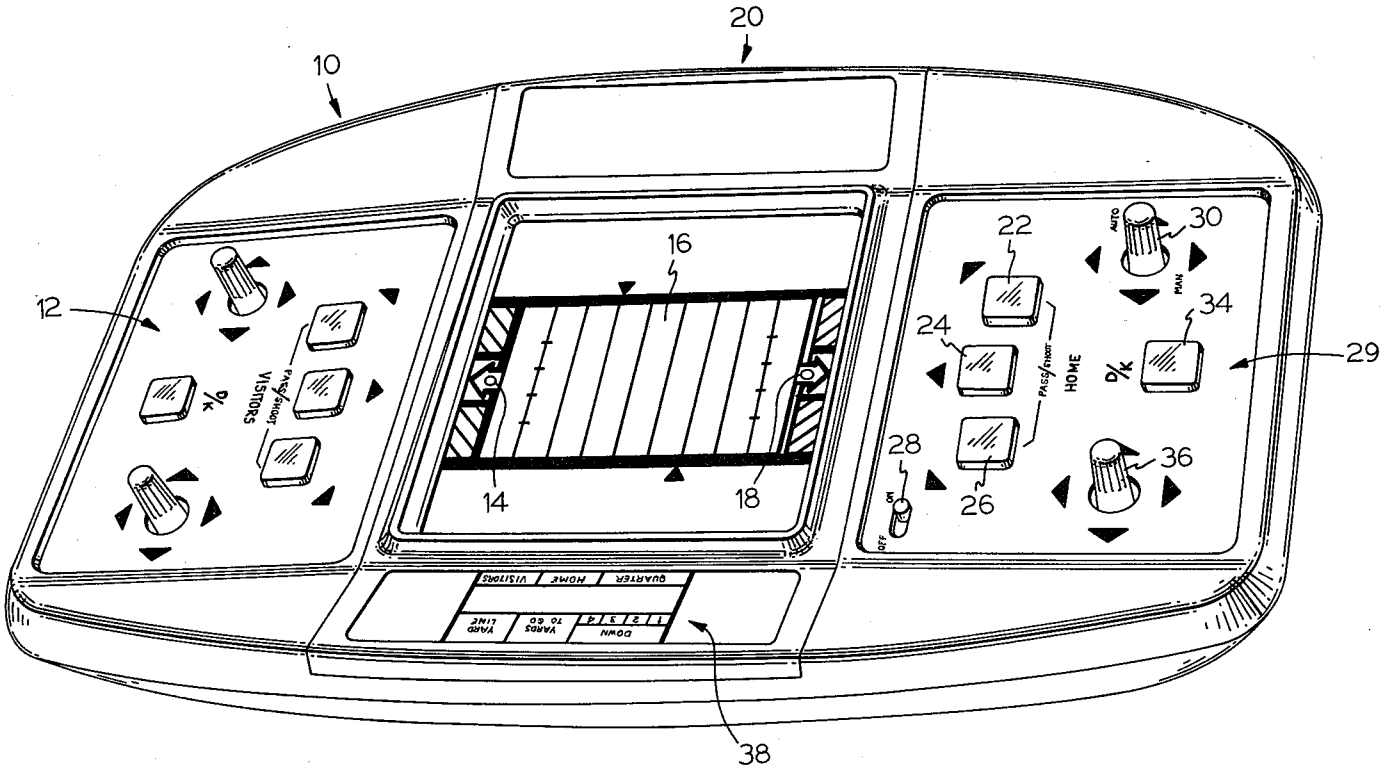
FIG. 1 is a perspective view of an electronic game employing the teachings of the present invention.
Figure 2:
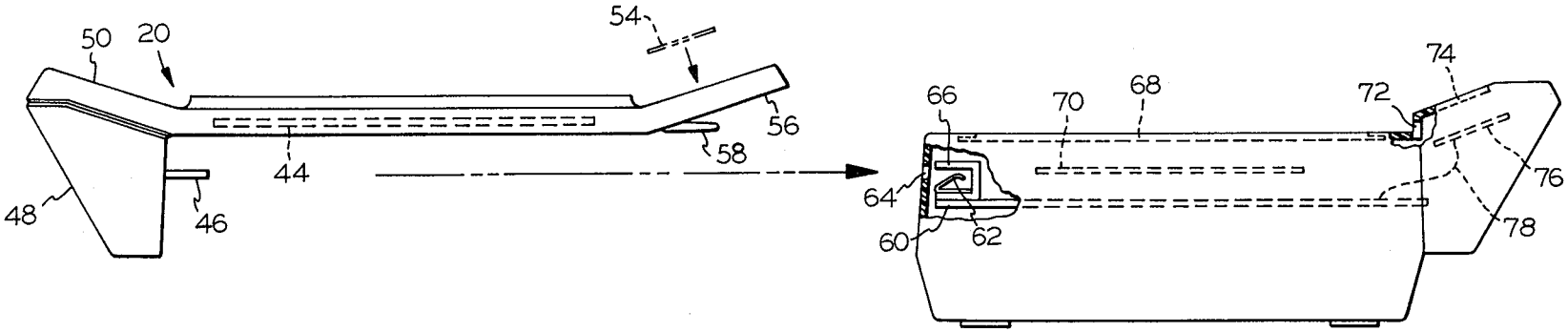
FIG. 2 is an end view, partially broken away, of the game showing its cartridge separated from the main housing.
Figure 3:
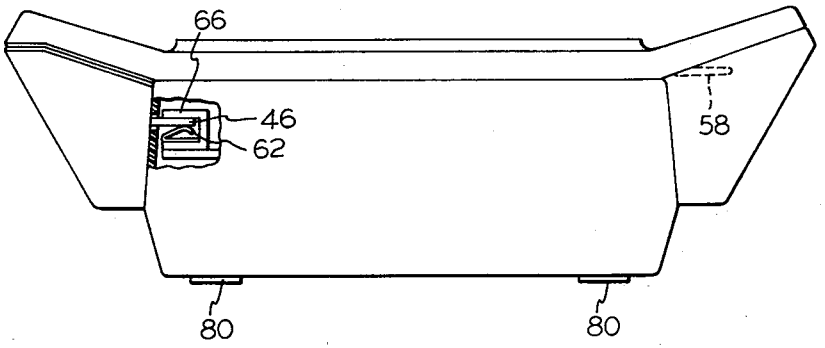
FIG. 3 is a view similar to FIG. 2 but with the cartridge in place.
Figure 4:
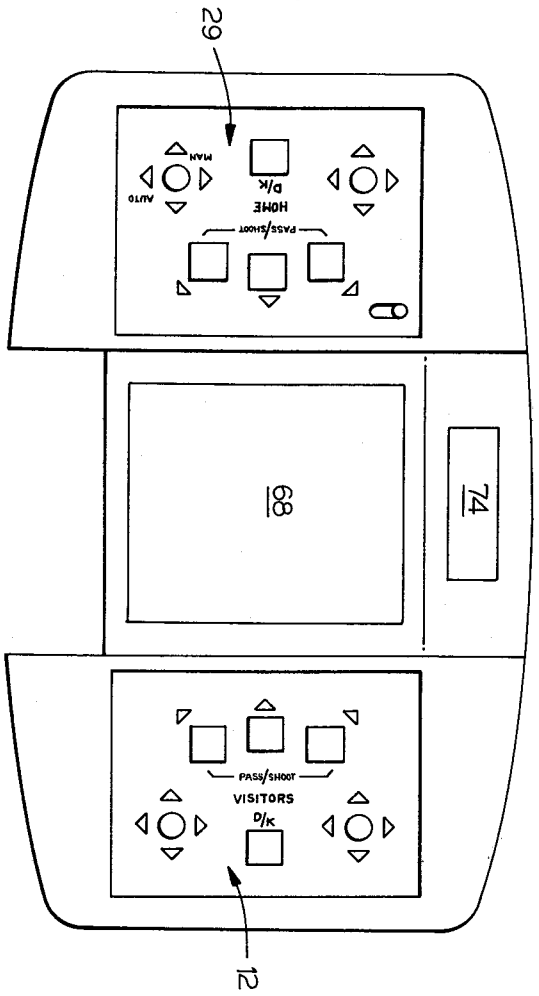
FIG. 4 is a simplified plan view of the main housing without the cartridge.
Figure 14:
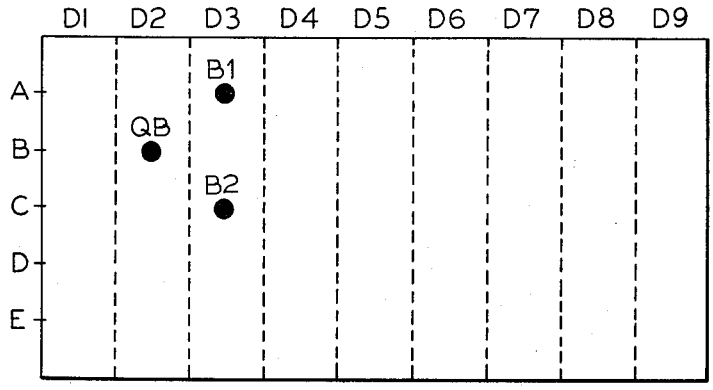
FIGS. 14–16 are similar views illustrating a series of moves employed to change the relative positions of the concurrently movable offensive players.
Figure 15:
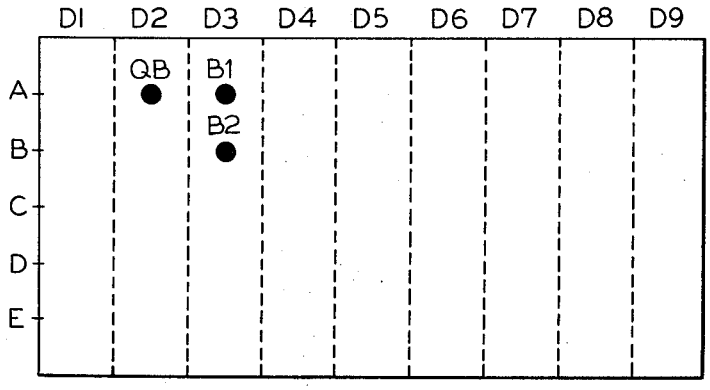
Figure 16:
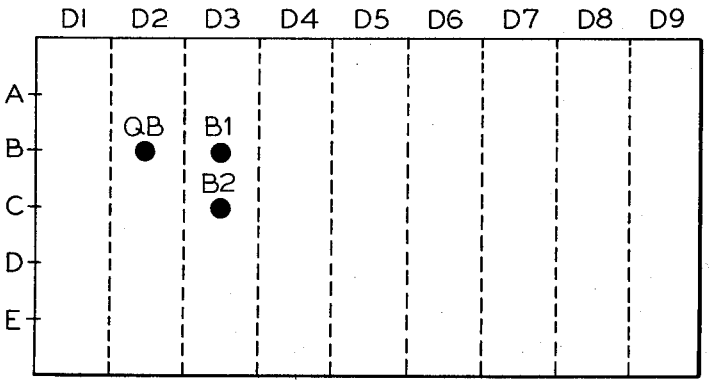

The drawings illustrate an electronic game in which there are provided two switch assemblies, evidenced in FIG. 1 by levers 30 and 36, that are used to independently and simultaneously control player symbols on the same team. As embodied in FIG. 1, the device is employed to simulate American football, but FIGS. 2–4 illustrate that a central cartridge portion can be removed and replaced so as to allow other games to be played. In the football version it is possible by operating right-hand lever 30 to move three of the four offensive play symbols concurrently, as FIGS. 14–16 illustrate. By moving the symbols against a side boundary, their relative positions can be changed, and the circuit for providing the game is so programmed that the new relative positions of the play symbols remain after they are moved back away from the boundary. The three symbols controlled by right-hand lever 30 are also prevented from moving to the position of the receiver symbol (RC) controlled by left-hand lever 36, as FIGS. 17–19 indicate, and the relative positions of the three other offensive play symbols can therefore also be changed by proper maneuvering of the receiver symbol.

A more detailed inspection of FIG. 1 reveals that the game 10 includes an elongated housing having opposing control panels 12 and 29 at the two ends. A simulated playing field 16 and a scoreboard 38 are provided between the ends, the play action and status information being conveyed by light-emitting diodes that are common to all versions of the game. Overlying the light-emitting diodes is a cartridge 20 that fits on the housing between the ends and provides the simulated playing field and scoreboard legends peculiar to the game to be played.

The home control panel includes three pass/shoot switches 22, 24, and 26 whose operations cause right diagonal, straight forward, and left diagonal passes, respectively. These keys are also used at the beginning of a play to set up the initial formations of the symbols.

Two levers 30 and 36 are provided to direct the movements of the play symbols that are controlled by the operator. Each lever can be used to selectively operate one of four switches that are described below in connection with FIG. 9. Movement of the lever forward causes one step of the controlled symbol in the forward direction. A single operation of the lever results in only a single step of movement, so repeated operations in a given direction are necessary to cause a symbol to move more than one step in that direction. The lever can also be moved backward, left, and right in order to direct one step of movement backward, left, and right. When the home team is on offense, right-hand lever 30 is employed to control the three concurrently movable offensive players, namely, the quarterback and two blockers, while lever 36 controls the remaining offensive play symbol, which is a simulated receiver and can also act as a third blocker. On defense, each lever controls a single defensive player, the remaining defensive players being controlled by the circuitry in a manner that is "intelligent" but somewhat unpredictable to the operators.

Between levers 30 and 36 there is provided a key 34 labeled "D/K" for directing a kick or operating the display of the various status information. Finally, an on/off switch 28 is provided to apply power to the unit. The visitors' control panel is similar to the home control panel, but it does not include an on/off switch.

As was noted above, the apparatus can be employed to simulate more than one game. Cartridge 20 is removable from the main body of the game, as FIGS. 2–4 illustrate. In order to change the game to be simulated, cartridge 20 is removed and replaced with a cartridge that is similar in shape but has different playing-field and scoreboard markings. As FIGS. 2 and 4 show, the main body of the game contains a main printed-circuit board 60 mounted horizontally inside it, and the LED matrix is provided on a board 70 that is supported on the printed-circuit board and electrically connected to it. Board 70 provides two indicator LEDs at its opposite ends and a five-by-nine matrix of LEDs between them. The positions of the indicator LEDs are designated in FIG. 1 by reference numerals 14 and 18. These indicator LEDs tell the operators on which half of the playing field the ball is positioned; the scoreboard may indicate that the ball is on, say, the thirty-yard line, and the indicator LEDs would tell whether it is the home or the visitors' thirty-yard line.

There is also mounted in the right-hand portion of the main housing as viewed in FIG. 2 a further LED board 76 that contains the LEDs for the scoreboard. It is electrically connected to the main printed-circuit board 60 by a twelve-wire connector 78. Board 76 contains four seven-segment red-LED digits as well as four single green LEDs. The red-LED digits convey the score or the field position in the football version, while the green LEDs represent the quarter or the down.

For appearance purposes, two tinted acrylic filters 68 and 74 are provided on the upper surface of the main housing. Filter 68 covers LED board 70, while filter 74 covers LED board 76. With these filters, only the energized LEDs, and not the surrounding circuitry, are visible.

The cartridge, which is seen removed from the main housing in FIG. 2, includes an upper, generally flat portion 50 and a more compact lower portion 48 that depends from the left end of upper portion 50. A scoreboard overlay 54 is inserted in the right-hand portion of the cartridge. This overlay is a clear vinyl sheet with scoreboard legends scribed on it that are applicable to American football. Another clear-acrylic overlay 44 is provided with various indicia that are characteristic of a field on which American football is played. When the cartridge is in place, overlay 54 is disposed in registration with filter 74 and board 76, while overlay 44 is disposed in registration with filter 68 and board 70.

Lower portion 48 of the cartridge has a printed-circuit board 46 mounted in it and extending to the right, while upper cartridge portion 50 provides a mounting finger 58 that extends to the right. When the cartridge is inserted into the main housing, mounting finger 58 is received in an opening 72 in the right-hand portion of the main housing, while printed-circuit board 46 is received in an opening 64 in the left wall of the housing. When printed-circuit board 46 is so inserted, it engages resilient contact fingers 62 that are part of a connector assembly mounted at the left end of main printed-circuit board 60. The contact assembly includes a flange portion 66 that is disposed above contacts 62 and engages the upper surface of printed-circuit board 46 to provide a snug fit and thereby insure proper electrical connection between printed-circuit board 46 and contacts 62. Printed-circuit board 46 is configured differently for different games, and the circuitry on main printed-circuit board 60 determines which game to simulate by interrogating printed-circuit board 46.

Although the game is sized to permit it to be played while being held in the operator's hand, it is customarily played while the housing is resting on a horizontal surface. Accordingly, it may be desirable to provide appropriate feet, such as those designated by reference numeral 80 in FIG. 3, to provide stability and prevent furniture from being marred unnecessarily.

Figure 5A:
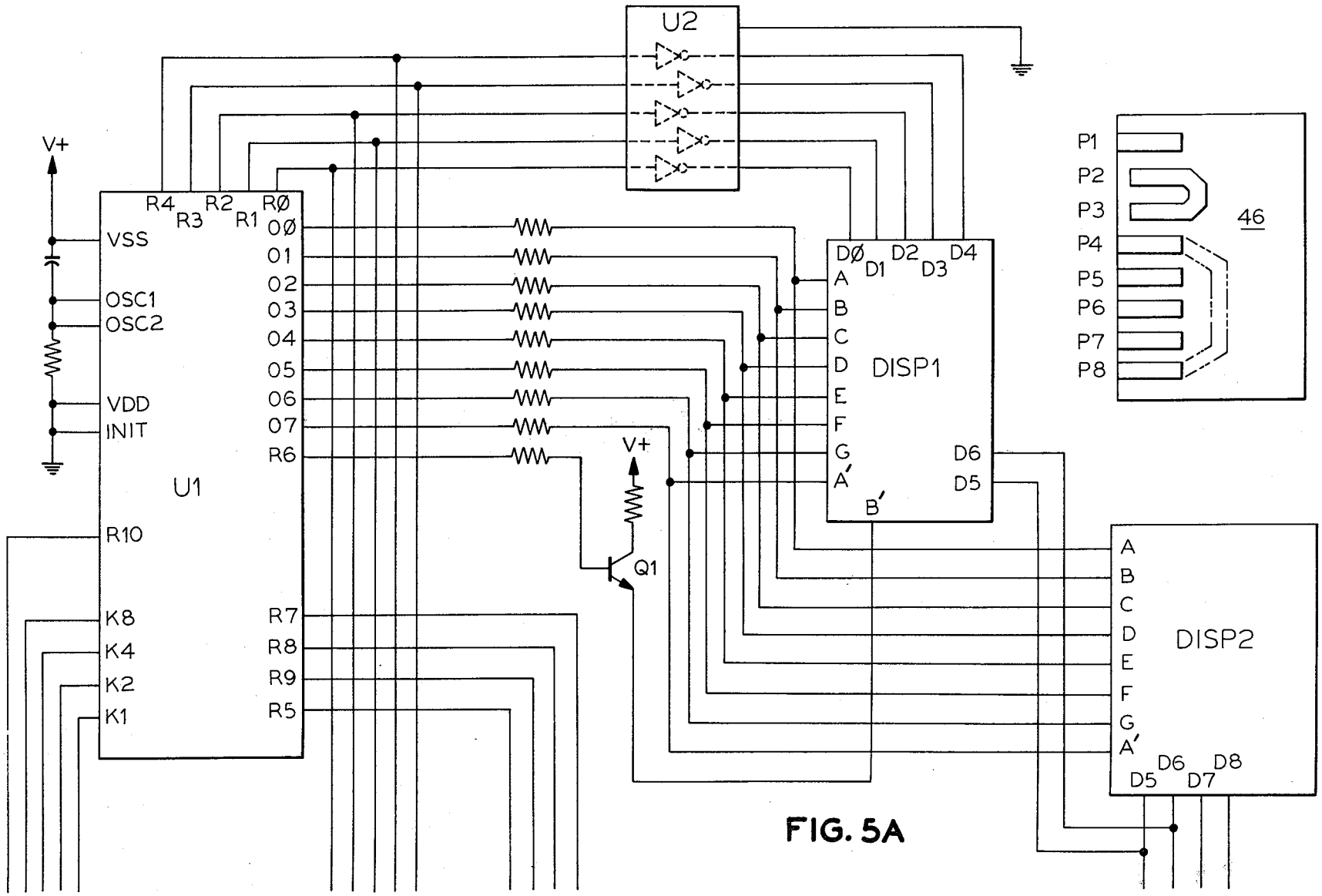
FIGS. 5A and 5B are together a schematic diagram of the circuit that is contained in the housing and provides the game action.
Figure 5B:
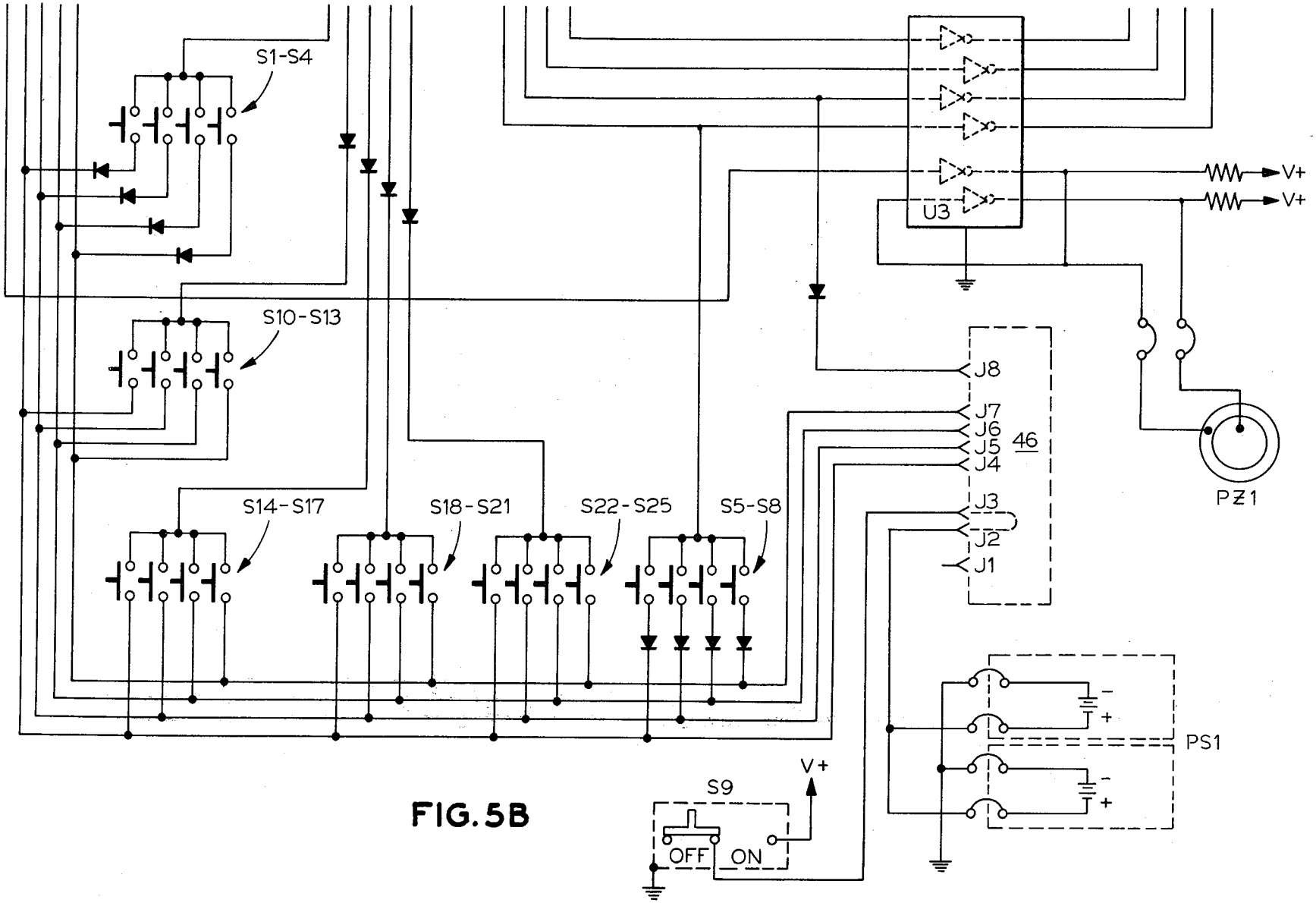

The operational circuitry provided in the game is illustrated in FIGS. 5A and 5B. FIG. 5B is a continuation of FIG. 5A, and the circuit lines extending to the bottom of FIG. 5A are continued at the top of FIG. 5B at the same location. The circuitry will not be described in great detail; those skilled in the art will recognize the individual elements and appreciate their purposes. The following somewhat abbreviated discussion is therefore considered adequate.

The heart of the circuit is a microprocessor U1. In this case, U1 is a Texas Instruments TMS 1400. As will be recognized by those skilled in the art, the microprocessor is programmed by providing read-only memory in U1 according to the requirements of the game manufacturer. The read-only memory contains the programming necessary to provide the features described further on in this specification.

The circuit also includes the usual power supply PS1, which in this case consists of two nine-volt batteries connected in parallel to supply power to the various circuit elements, including U1. U1 communicates with the other circuit elements by various input/output terminals that are labeled in FIG. 5A in the customary manner. Those skilled in the art will recognize that the choice of terminals for connection to various of the other circuit elements is to a large extent a matter of choice. Of course, once the connections have been decided upon and the ROM has been programmed, the connections cannot be changed without reprogramming.

Communication with the control panels is provided in the illustrated embodiment by terminals R0-R5 and K1, K2, K4, and K8. These terminals are connected to switches S1–S8 and S10–S25. Switches S1–S4 are the keys on one of the control panels, while switches S5–S8 are the keys on the other control panel. It can be seen that these two sets of four switches are connected to a common data bus that in turn is connected to U1 terminals K1, K2, K4, and K8. The difference between the two sets of switches is that switches S1–S4 are interrogated by U1 terminal R0, while switches S5–S8 are interrogated by terminal R5.

The four other groups of four switches, which also are connected to the common data bus, are operated by direction levers such as levers 30 and 36. Each lever controls its own set of four switches; for instance, switches S10–S13 are all controlled by a common lever and are all interrogated by terminal R2. When a lever is operated in the forward direction, one of its associated switches is closed, and the rest of the four associated with it remain open. Operation in each of the other three directions results in closure of a switch associated with that direction. The other sets of four switches operate similarly under control of levers associated with the sets.

In short, therefore, the keyboard switches (with the exception of the on/off switch) communicate with U1 on a common four-line bus, each set of four switches having its own interrogating terminal on the microprocessor.

Microprocessor U1 is programmed to enable it to provide football, basketball, soccer, and hockey. It determines which of these games to simulate by interrogating printed-circuit board 46, whose circuit paths are illustrated in FIG. 5A. The specific arrangement of the circuit paths is only exemplary, because the specific connections depend on which game is to be played. The phantom lines in FIG. 5A represent the proper connection for football; if the microprocessor senses that P4 is connected to P8, it simulates football. Connection of P8 to P5, P6, or P7 would cause simulation of hockey, soccer, or basketball, respectively.

The connection of printed-circuit board 46 to microprocessor U1 is depicted in FIG. 5B where connector terminals J1–J8 represent the contacts (contacts 62 in FIGS. 2 and 3) that engage printed-circuit terminals P1–P8, respectively. It is thus seen that interrogation of the printed-circuit board that determines which game is to be simulated is initiated by terminal R9, and the information is forwarded along the common bus employed by the control-board switches. It can also be seen in FIG. 5B that the game is inoperative if the cartridge is removed, because printed-circuit board 46 connects the power source to on/off switch S9 (switch 28 of FIG. 1).

Microprocessor U1 also communicates with the playing field and the scoreboard. The playing-field LEDs are provided on DISP1, the schematic representation of the circuitry on board 70 of FIG. 2. DISP1, provides forty-five red LEDs along x- and y-axes to provide a matrix of five rows and nine columns. As was mentioned above, it also provides the two further LEDs, one at point 14 in FIG. 1, the other at point 18. A given LED is driven by causing current to flow between a pair of DISP1 terminals associated with it. Each of the terminals D0–D4 on DISP1 is associated with a separate row of the red-LED matrix, while each of terminals A′, B′, and A–D is associated with a separate column. The two indicator LEDs are associated with terminal B′ and one or the other of D5 and D6.

In order to keep a full roster of player symbols on the display, it is necessary to multiplex the display in a conventional manner. An exemplary multiplexing scheme is described, for instance, in United States Patent No. 4,249,735, granted Feb. 10, 1981, to Eric Bromley for an "Electric Simulated Football Game and Method." The Bromley patent is hereby incorporated by reference.

Those skilled in the art will recognize that current amplification is needed in order for some of the terminals to drive the LEDs. For this purpose, transistor Q1 and inverter chip U2 are interposed at appropriate places in the lines between microprocessor U1 and DISP1.

As was mentioned before, the scoreboard display is provided by four seven-segment red-LED digits and four single green LEDs. These are provided by DISP2, which is the schematic representation of the circuitry on board 76 of FIG. 2. Selection of a given digit or green dot is accomplished by selection of one of the terminals D5–D8, while selection of the digit segment is accomplished by selection of one or more of terminals A–G of DISP1. Terminal A′ of DISP2 is the common terminal for the four green LEDs. Current amplification is provided by inverter chip U3.

As is conventional in games of this type, sound effects are provided during play-action simulation. Microprocessor U1 provides the sound effects by impressing an appropriate signal on its terminal R10. This signal and its complement are provided at two of the output terminals of U3 and are used to drive a piezoelectric transducer PZ1.

Figure 6:
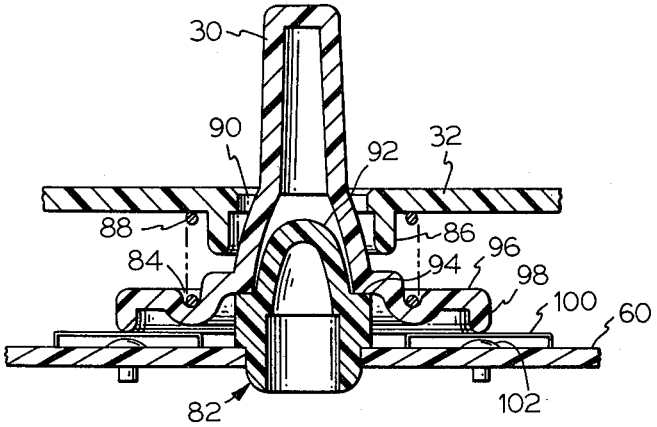
FIG. 6 is a cross-sectional view of one of the switch assemblies provided for directing the motion of the play symbols.

It was noted above that the four sets of four switches are operated by manipulation of the four direction levers on the control panels. The switch assembly by which this is accomplished is shown in FIGS. 6–9. FIG. 6 shows the upper plate 32 of control panel 29. Plate 32 provides a circular opening 90 through which lever 30 extends. Below plate 32, lever 30 widens into a disc portion 96 by which it rests on a base member 82. Base member 82 includes a boss portion 92 that extends into the interior of hollow lever 30. Around the bottom of boss portion 92 is provided an annular shoulder 94 that supports disc portion 96 of lever 30. A downwardly extending annular flange 86 is provided by plate 32 around opening 90. This flange acts as a positioner that extends axially inside a coil spring 88, which is compressed between plate 32 and an annular recess 84 in the upper surface of disc portion 96 of lever 30. Spring 88 accordingly biases lever 30 to the position shown in FIG. 6.

Figure 8:
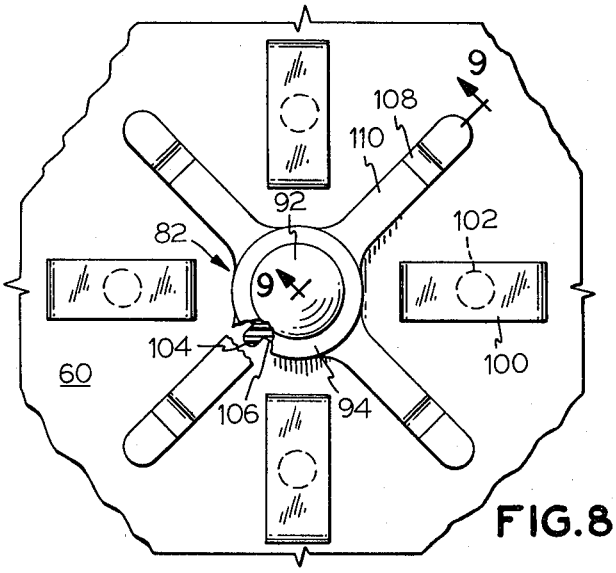
FIG. 8 is a plan view with parts removed of the switch assembly of FIG. 6.

Base member 82 is secured in an opening in main printed-circuit board 60 between four equiangularly disposed switches evidenced in FIG. 8 by upper contact members 100.

FIG. 6 illustrates that the rectangular upper contact members 100 are disposed above eyelet contacts 102 provided in circuit board 60 and spaced slightly above them. An annular flange 98 is provided on the disc portion 96 of lever 30 and just touches each upper contact 100. Contacts 100 and 102 and similar pairs of contacts constitute the switches identified in FIG. 5B as S10–S25.

Figure 7:
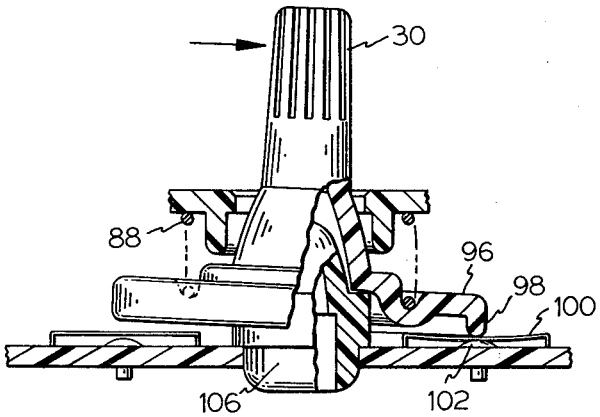
FIG. 7 is a partially cross-sectional view of the switch assembly of FIG. 6 showing one of the switches pivoted from is rest position.

Lever 30 has a knurled surface, as FIG. 7 shows. When the operator tilts lever 30 in one of the four directions, disc portion 96 is also tilted, causing flange 98 to urge one of the contacts 100 against its associated contact 102 to close the switch. It will be appreicated that spring 88, in addition to biasing lever 30 to its neutral position, also provides the force that closes the switch when lever 30 is tilted.

Figure 9:
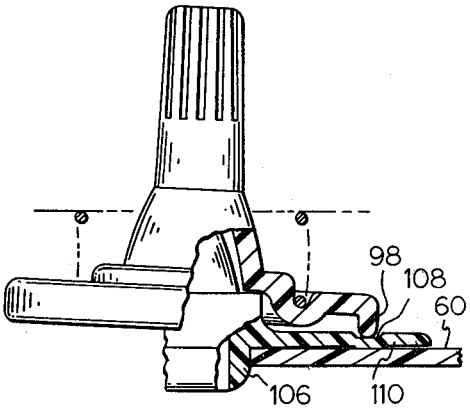
FIG. 9 is a partly sectional view taken at line 9—9 of FIG. 8.

In order to prevent operation of two switches at a time, base member 82 is provided with four arms 110, each of which extends between a pair of adjacent switches. Each arm 110 is provided with a recess 108 at the radial position of annular flange 98, as FIG. 9 illustrates. In order to operate two of the switches, the portions of annular flange 98 engaging both switches would have to be at approximately the same distance above printed-circuit board 60, and a portion of annular flange 98 between those two points would have to be even lower. Since the intermediate portion is prevented by arm 110 from descending by the requisite amount, simultaneous operation of the two adjacent switches is prevented.

A tab 104 extending down into a complementary recess in printed-circuit board 60 extends outward from surface 106 of base 82 to key base 82 in proper angular position.

It should be noted that the switch illustrated in FIGS. 6–9 is particularly advantageous in a game of this type, in which two levers are provided on each side so that an operator can control two independently movable play symbols simultaneously. In previous games, several keys have usually been provided, one key for each direction of movement. Therefore, in order to control one play symbol or a concurrently moving group of play symbols, it was necessary to provide a number of keys equal to the number of possible directions in which the play symbols might be guided. Thus, although it is conceivable for an operator to have learned to direct his play symbols by touch, it more frequently occurred that it was necessary for the operator to take his eyes off the play symbols at least occasionally in order to locate the proper direction key. When such glances were avoided, the operator often operated the wrong key. Other games have used a single cruciform operating element for directing the play symbols. This was only a slight improvement over the multiple-key arrangement because it was still necessary for the operator to move his fingers among the arms of the element in order to direct his play symbols.

With the arrangement illustrated in FIGS. 6–9, the operator can keep his fingers on the same position on lever 30 at all times, and it is never necessary for him to move his fingers relative to lever 30. It will be appreciated that this feature is particularly advantageous if two independently movable play symbols are to be controlled, because time spent in positioning the fingers would doubly detract from the operator's concentration on the playing field in such a situation.

Figure 10:
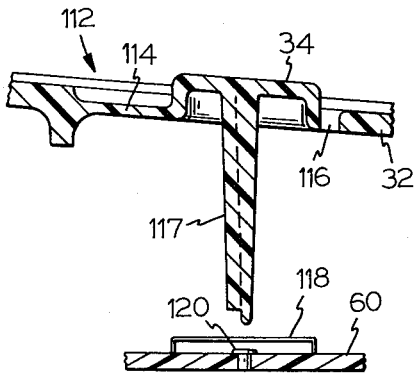
FIG. 10 is a cross-sectional view of one of the other switches on the control panel.

It has been found convenient to provide the switches operated by keys 22, 24, 26, and 34 with contacts similar to those provided on the switches operated by lever 30. FIG. 10 illustrates such a switch. Upper plate 32 of control panel 29 is provided with an L-shaped opening 116 that defines an elongated arm 112 having a relieved portion 114 that extends to a raised portion that acts as key 34. Arm 112 is relieved at 114 to make it easily deflectable. Thus, an operator can depress key 34, thereby causing a finger 117 depending from key 34 to operate the switch provided by contacts 118 and 120.

In order to begin the play of the game, the home operator operates right-hand lever 30 from its rest position and holds it in one of the other four positions while he operates switch 28 to the ON position. If lever 30 is in the forward position when the game is turned on, the operator plays against the microprocessor. If lever 30 is in the right-hand position when the game is turned on, the operator still plays against the microprocessor, but the microprocessor plays at a higher skill lever. With lever 30 initially in its left-hand position, the operator plays against an operator manning visitor control panel 12, and initial positioning of lever 30 in the rearward position also results in two-player operation. The difference between these last two positions is that the microprocessor-controlled symbols are in general moved more frequently when lever 30 has been placed initially in the left-hand position.

After the game has been turned on, the home team starts out with a first down and ten yards to go on its own twenty-yard line. The home-team operator then has the option to press one of the pass keys 22, 24, and 26, which are also operative to change the initial formation. The visiting-team operator also has the option to change his initial formation by operating one of the corresponding keys on his control panel. After one of the keys is depressed to select a particular formation, the formation can be changed by depressing another one of the keys, and such changes can continue until the first movement of an offensive play symbol is directed by manipulation of one of the offensive-team direction levers.

Figure 11:
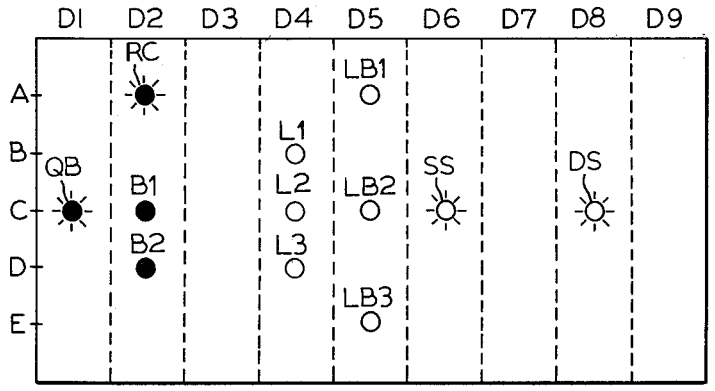
FIGS. 11–13 are simplified views of the playing field illustrating various initial formations.

If the home-team operator has depressed center key 24 and he is on offense, his play symbols will be lined up as illustrated in FIG. 11. The offensive play symbols are displayed as bright dots and are represented in FIG. 11 by solid circles, while the defensive play symbols are provided by dimmer LEDs and are represented in FIG. 11 by open circles. The play symbols labeled QB, RC, SS, and DS are distinguished in FIG. 11 to indicate that these symbols are pulsed. The SS and DS symbols are pulsed to indicate that they are the (separately) controllable defensive play symbols, and the QB and RC symbols are pulsed to distinguish them from the blockers. Offensive play symbols B1 and B2 move concurrenlty with symbol QB; i.e., when a move of the QB symbol is directed, that same move of the B1 and B2 symbols is also directed.

FIG. 11 also depicts the arrangement of defensive play symbols that results from operation by the defensive operator of his central pass key.

Figure 12:
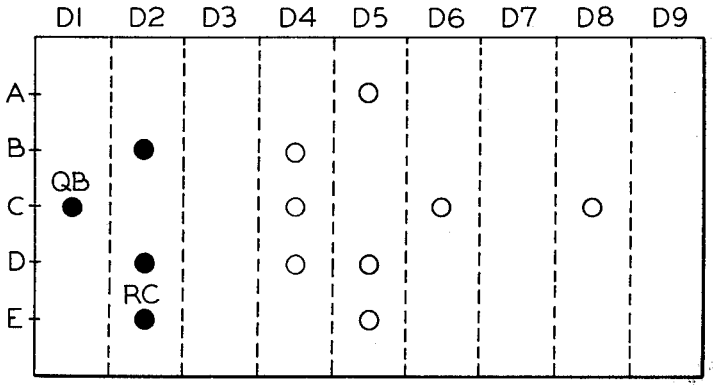
Figure 13:
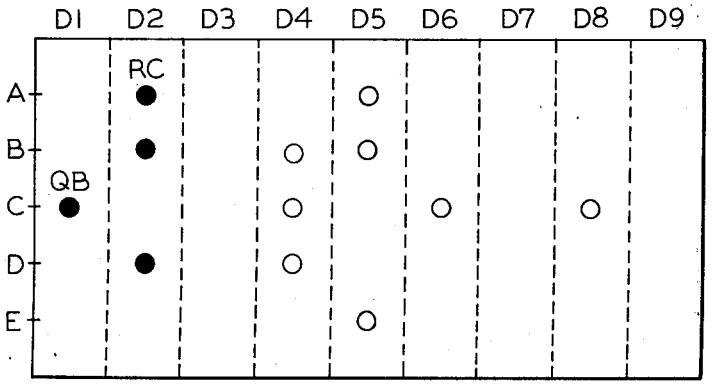

FIG. 12 shows the initial formations that result from operation of the right-hand pass key by the offensive operator and the left-hand pass key by the defensive operator, while FIG. 13 shows the initial formations that result from operation of the left-hand pass key by the offensive operator and the right-hand pass key by the defensive operator.

Action starts when the offensive operator operates one of his direction levers. At that point, the pass keys become dedicated to their pass functions, so no more initial-formation changes may be made. Operation of one of the keys now causes a pass to be simulated by sequential operations of LEDs in a straight line beginning at the position of the QB symbol.

Examples of complete plays will not be given here. The game action is similar in many respects to that illustrated in the Bromley application mentioned above. Generally speaking, the offensive operator attempts to move the ball-position symbol, which is initially the quarterback, through the defensive play symbols in order to gain as much "yardage" as possible and ultimately achieve a simulated touchdown. When blocker B1 or B2 coincides with a defensive play symbol, the two coincident players disappear for the remainder of the play. The play ordinarily ends when a score occurs or the ball-position symbol coincides with a defensive play symbol.

As is typical in games of this type, the ball-position symbol is initially the same as the quarterback symbol. However, a separate ball-position symbol executes a straight-line path when one of the pass keys is operated, and if the separate ball-position symbol then coincides with the receiver (RC) symbol, the RC symbol becomes the ball-position symbol.

When an offensive operator is playing against the defensive operator, moves of all the defensive play symbols except SS and DS are directed by the microprocessor in a manner that is "intelligent" but somewhat unpredictable to the operator. Schemes for providing this microprocessor-controlled motion are known in the art, an exemplary scheme having been set out in the Bromley application referred to above. When the offensive operator plays against the microprocessor, all of the defensive players are controlled by it.

By reference to the Bromley application and the above outline, those skilled in the art will understand the general features of the play action. Accordingly, what follows is only a discussion of a few specific features.

The RC symbol is operable by lever 36 when the home team is on offense. It moves separately from the other three offensive play symbols, which generally move as a group in response to directions from lever 30. Unlike B1 and B2, RC is prevented from coinciding with any of the defensive play symbols. All of the offensive play symbols are prevented from coinciding with each other.

The RC symbol is the eligible pass receiver, and it is the only symbol whose coincidence with the ball-position symbol during a simulated pass results in a simulated completed pass. A pass is initiated, as was mentioned before, by operating one of keys 22, 24, and 26 if the home team is on offense and by operating one of the corresponding keys on the other control panel if the visiting team is on offense. Depression of key 24 cause LEDs to be lighted sequentially in a row starting at the position of the QB symbol if the QB symbol has not passed the line of scrimmage. The line of scrimmage is the D3 column when the home team is on offense and the D7 column when the visiting team is on offense. Depression of key 22 also causes a pass to be simulated, but along a diagonal line to the right, and depression of key 26 causes a diagonal pass to the left.

During pass simulation, coincidence of the ball-position symbol with other symbols causes no interaction unless the other symbol is SS, DS, or RC, and these are the only symbols that can move during pass simulation. While the pass is being simulated, the SS and DS symbols are allowed one move, and the RC symbol can move repeatedly. Coincidence of the ball-position symbol with SS or DS during a pass results in an interception and the termination of the play, while, as was noted before, coincidence with RC results in its becoming the ball-position symbol. Once RC becomes the ball-position symbol, it is no longer prevented from coinciding with defensive play symbols, all of which "key" on the RC symbol once a pass key has been depressed. When a coincidence with the receiver symbol occurs after a pass reception, a tackle is simulated, and the play ends.

If the ball-position symbol passes column D9 or goes beyond row A or row E without being received or intercepted, the pass is incomplete, and the play ends.

As was indicated above, the D3 (or D7) column represents the line of scrimmage. Each column represents one yard of the hundred yard-long American football field. Consequently, if the QB symbol is "tackled" in the D1 column before it has had a chance to move out of that column, two yards are lost on the play. If the tackle occurs in the D9 column, six yards are gained on the play. As is the real game, it is possible to gain more than six yards; when the ball position symbol is in column D9 and the lever is operated to direct a forward move, the ball-position symbol "wraps around," reappearing at column D1. When this happens, all of the defensive players keep their positions on the playing field, but the offensive players other than the ball-position symbol disappear. Thus, the ball-position symbol is on its own after it "wraps around."

It was noted above that the position of lever 30 when the game is turned on determines not only whether both control panels are activated but also whether the skill level at which the game is to be played will be high or low. In the lower skill level, the computer-directed defensive play symbols are moved at no more than twelve moves per "tick." (The piezoelectric transducer makes a ticking sound during a play at regular intervals, and a "tick" occurs once every second or so.) In the higher skill level, the maximum number of moves is twelve per tick until the QB crosses the line of scrimmage, at which time the rate of defensive-player moves increases to a maximum of twenty-eight per tick. If a pass is executed before the QB crosses the line of scrimmage, the rate of defensive-player movement remains twelve per tick until the receiver has "wrapped around" twice. After that, the movement rate goes up to twenty-eight per tick.

It is thought that this is a rather advantageous feature of the embodiment illustrated in the drawings. Because of the greater risk incurred by running a passing play, particularly at the higher skill level, pass plays might be avoided if an incentive were not provided. In this arrangement, the incentive is that the defenders move more slowly when the ball carrier is in the secondary during a passing play than they do during a running play, at least until the second "wrap around."

Simulated kicks are also possible. After an initial offensive move, operation of D/K key 34 causes a kick to be simulated. When the key is depressed, all players are removed from the display, and the LEDs along row C are sequentially lighted to simulate the kick. The game internally assigns a length to the kick in a random manner, the possible kick distances being fifteen, twenty-five, thirty-five and forty-five yards. The chances of a fifteen-yard kick are one in sixteen, the chances of a twenty-five-yard kick are seven in sixteen, the chances of a thirty-five-yard kick are three in eight, and the chances of a forty-five-yard kick are one in eight. If the distance is greater than that to the goal line, a field goal (three points) is scored. Otherwise, possession is turned over to the other team at the field position that results from adding the length of the kick to the position of the previous line of scrimmage.

It will be appreciated that it is possible for the line of scrimmage to occur in the offensive team's two-yard line or one-yard line. Accordingly, it is conceivable for a simulated tackle to occur in the "end zone." If this happens, a safety (two points) is scored.

When a play has ended, the scoreboard displays the down number, the number of yards to go for a first down, and the number of the yard line. The green LEDs display the down number, the first through fourth LEDs representing the first through fourth downs, respectively. The four LED digits indicate how many yards are required for a first down and also display the number of the yard line. Since positions on opposite sides of the field have the same-yard line numbers, indicator LEDs 14 and 18 on the field display indicate which side of the field the ball is on.

Once the field position has been noted, the offensive operator depresses his D/K key. As a result, the display is changed so that the four green LEDs represent the period of play, while the four LED digits display the score. A subsequent depression of the D/K key causes the formations to be set for the next play. At this point, each operator can depress one of the pass keys to change the initial formation. If no formation key is pressed, the formations of FIG. 11 result.

As is conventional in games of this type, sound effects are provided to represent the passage of time, to accompany a pass, and to signal the occurrences of turnovers, scores, and tackles.

A couple of the features described above merit particular consideration. The first, which has already been discussed, is the provision of the elongated levers 30 and 36 to simultaneously control independently movable players of the same team. The elongated-lever arrangement permits control in four directions without any necessity for glancing at the control or moving one's fingers about them. Consequently, simultaneous control of independently movable players on the same team is realistically afforded.

Another feature of particular interest is the manner in which the formation defined by the relative positions of the concurrently movable play symbols can be affected. This feature is illustrated in connection with FIGS. 14–19. FIGS. 14–16 show only the three concurrently movable offensive play symbols; RC, the independent offensive play synbol, is not shown, and neither are the defensive play symbols. As was mentioned previously, manipulation of lever 30 (or the corresponding lever on the other control panel if the visitors are on offense) causes concurrent movement of the three offensive play symbols illustrated. In other words, they move as a group, each mover directed by lever 30 being directed to all of the three concurrently movable play symbols. However, the microprocessor is programmed to prevent some directed moves from being effected, so there are some situations in which one or more of the concurrenlty movable offensive play symbols do not move with the others.

Such a situation is illustrated in FIGS. 14–16, where B1 is shown in FIG. 14 to be in a boundary position. Movement of B1 beyond the boundary position is prohibited by the microprocessor. Accordingly, when lever 30 is moved to the left, QB and B2 move upward, but B1 is prevented from doing so. Thus, the relative positions of the concurrently movable offensive play symbols is changed, as FIG. 15 illustrates. FIG. 16, which illustrates the result of operating the lever once to the right, shows that this new formation is maintained when the concurrently movable players are directed back from the boundary.

It is believed that this feature is quite valuable because it permits rearrangement of the relative positions of the concurrently movable play symbols even though only one directional lever is provided. Thus, a greater scope of play possibilities is provided without increasing the complexity of the manipulations that the operator must perform.

Although not illustrated in the drawings, a similar realignment could be achieved by employing the other side boundary positions, those along row E. Furthermore, there is no "reverse wrap around," so movements beyond column D1 are also prohibited. Therefore, one of the end boundaries can also be employed to effect formation changes.

All positional changes result from a priority system for computing moves, a system that creates the opportunities for formation change. When B1 is positioned adjacent B2 on the same yardline and the concurrently movable symbols are directed to move to the left, both do so even though B2 is directed to move to a position that is already occupied by B1 at the time that the move is directed. This is because the microprocessor computes a leftward move of B1 before it computes the leftward move of B2. before it computes the leftward move of B2. It therefore considers the position to which B2 is to move to be unoccupied.

This is a specific example of the general priority system for computing the moves of the concurrently movable symbols. When a rightward move is directed, the moves are computed in the following order: B2, B1, and QB. On all other moves, the following order of computation is observed: B1, B2, and QB. This priority system results in the expected concurrent movement in most cases, but it can also be used to effect formation changes. For instance, if the QB symbol is immediately behind blocker B1 and the concurrently moving plurality is directed to move backward, the QB symbol will move backward, but the B1 symbol will not, because the move of B1 is computed while the QB symbol is still considered by the microprocessor to be in the position to which B1 has been directed to move. That position is thus prohibited to B1, and it does not move. The spacing between QB and B1 is thereby increased.

Figure 17:
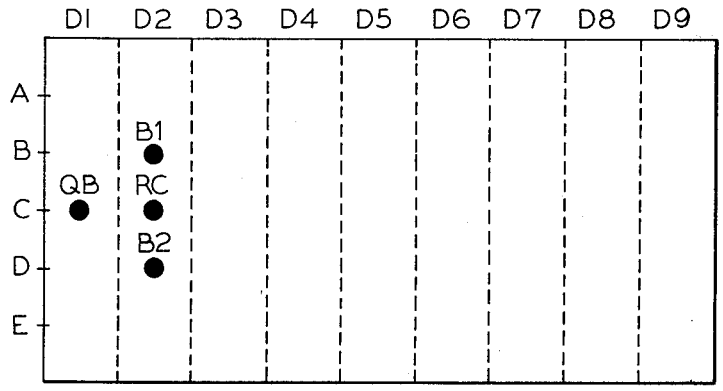
FIGS. 17–19 also illustrate a series of moves employed to change the relative positions of the offensive players.
Figure 18:
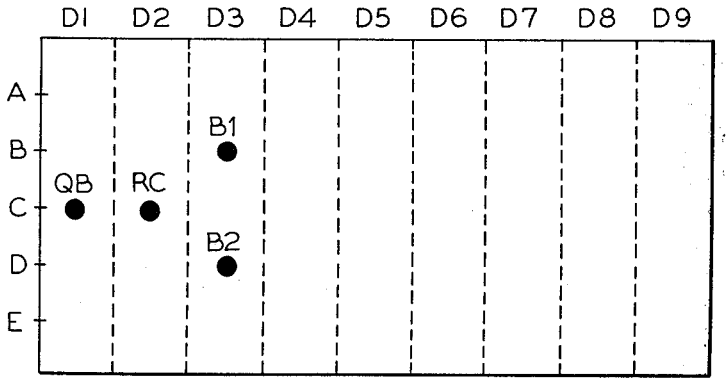
Figure 19:
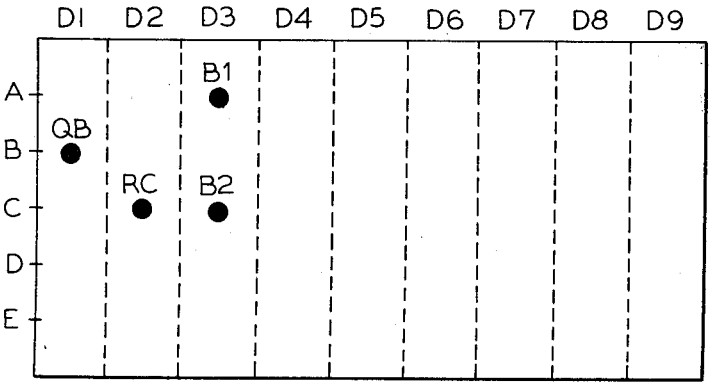

Although it is believed that the foregoing features alone provide a significant advance in the art, a further advantage is achieved when this feature is provided in conjunction with the independently movable symbol RC. As was noted above, symbol RC is prevented from moving to the positions of other offensive play symbols, and they in turn are prohibited from moving to its position. Consequently, this symbol can also be used in achieving formation changes. An exemplary formation change is illustrated in FIGS. 17–19. In FIG. 17, RC is positioned in front of QB and between B1 and B2. Because of the position of RC, QB cannot move forward, but B1 and B2 can. Accordingly, if lever 30 is operated forward once, B1, B2, and QB will be directed to move forward, but the microprocessor will prevent QB from doing so. Accordingly, only B1 and B2 move forward, as FIG. 18 illustrates. This spreads out the formation, and further spreading could be achieved with repeated forward operations of lever 30. However, in the example given, layer 30 is next operated to the left instead of forward. Since RC does not prevent a leftward motion of any of the offensive play symbols, they can all move, and the new formation is maintained. If a forward operation of lever 30 then takes place, all of the concurrently movable play symbols move forward, maintaining the new formation.

It is clear from the foregoing examples that a wide variety of formation changes can be effected in addition to those that have been illustrated. This is especially apparent when it is realized that the concurrently movable play symbols, in addition to being prevented from moving beyond the boundaries and to the position of the RC symbol, are also prevented from moving to the position occupied by each other. Thus, the RC symbol, by being placed to the right of both of the blocker symbols in FIG. 15, for example, could be effective to prevent motion of both of them while the QB symbol moves by itself.

It is therefore apparent that the several features described above afford powerful means for increasing the variety of game action that can be provided in an electronic football game or in electronic games of other sorts that provides similar action. The microprocessor affords this type of operation by monitoring the positions of the offensive play symbols on the field—both their absolute positions and their positions relative to other players—and then assigning prohibited moves based on the monitored positions. Then, instead of preventing motion of all of the concurrently movable play symbols when a move is prohibited to one of them, it only prevents the movement of the one to which a prohibited move has been assigned. Finally, when a succeeding move is directed that is permitted to all of the concurrently movable play symbols, all of them move concurrently without regard to the initial formation, so the new formation is maintained. This feature is particularly advantageous if some of the prohibited moves are moves to the position of at least one separate player symbol, especially if that symbol is itself independently movable. By affording these features, a great degree of versatility is afforded.

Having thus described the invention, I claim:

1. In an electronic apparatus for simulating a sports-action team game, the combination comprising a. a housing;

b. a display panel on the upper surface of said housing providing a visual simulation of a playing field of the type on which a ball-type game is played and adapted to display symbols in and between side and end boundary positions on said field in response to electrical signals applied thereto;

c. operational-circuit means in said housing operatively connected to said display panel for generation and transmission of electrical signals to said display panel to produce offensive and defensive play symbols on said simulated playing field, one of said offensive play symbols at a time simulating the position of the ball, said operational-circuit means including:

(i) means for moving a multiplicity of said offensive play symbols, including said ball-position symbol, along said playing field, said multiplicity of offensive play symbols including a concurrently movable plurality thereof;

(ii) means for moving a multiplicity of said defensive play symbols along said playing field toward said ball-position symbol, movement of said offensive and defensive play symbols providing play action simulating the action of said sports-action team game;

(iii) means for detecting the coincidence of said ball-position symbol with at least a selected one of said defensive play symbols during at least a portion of a play and terminating play action upon such detection;

(iv) means for monitoring the position of at least one of said concurrently movable plurality of offensive play symbols, means assigning prohibited moves thereto based on its monitored position on said playing field, and means for preventing said prohibited moves of said at least one offensive play symbol by said offensive-play-symbol-movement means; and (v) means for monitoring play action to record information concerning the status of said simulated game and for producing signals indicative of said status information, said signals conveying the recorded information to an operator of said game; and d. a control board on said housing including a multiplicity of manually operable control elements, said control board being connected to said operational-circuit means for transmission of signals thereto through operation of said control elements, said offensive-play-symbol-movement means effecting movement of said ball-position symbol in response to operation of said control elements by the operator to effect movement of said ball-position symbol through said defensive play symbols to simulate advance of the ball, play action being terminated by said detecting means upon the occurrence of said game terminating coincidence at least one of said manually operable control elements transmitting signals to said operational-circuit means to direct moves of said concurrently movable plurality of offensive play symbols, operation of said at least one manually operable control element to direct a move of said concurrently movable plurality of offensive play symbols causing the same move in each of said concurrently movable plurality of offensive play symbols whose directed move is not prohibited as defined by said prohibiting move assigning means, any offensive symbol of said concurrently movable plurality whose move is prohibited by said preventing means remaining stationary during the movement of the others of said concurrently movable plurality to thereby change the formation defined by the relative positions of said concurrently movable plurality but again moving with said other offensive play symbols of said concurrently movable plurality upon the next directed move that is not prohibited, whereby an original formation can be changed and the new formation maintained by first directing a move that is prohibited to at least one but not all of said concurrently movable plurality and then directing a move that is not prohibited to any of said concurrently movable plurality.

2. The combination of claim 1 wherein said concurrently movable plurality of offensive play symbols includes said ball-position symbol.

3. The combination of claim 2 wherein the prohibited moves assigned by said means for assigning prohibited moves include moves to a position occupied by any other offensive play symbol of said concurrently movable plurality thereof.

4. The combination of claim 3 wherein said means for assigning prohibited moves monitors the position of more than one of said concurrently movable plurality of offensive play symbols, assigns prohibited moves thereto based on their monitored positions along said playing field, and prevents said prohibited moves of said more than one concurrently movable offensive play symbol by said offensive-play-symbol-movement means.

5. The combination of claim 4 wherein said means for assigning prohibited moves monitors the positions of all of said concurrently movable plurality of offensive play symbols, assigns prohibited moves thereto based on their monitored positions along said playing field, and prevents said prohibited moves thereof by said offensive-play-symbol-movement means.

6. The combination of claim 2 or 5 wherein the prohibited moves assigned by said means for assigning prohibited moves include moves to the position occupied by at least one symbol separate from said concurrently movable plurality.

7. The combination of claim 6 wherein said separate symbol is one of said multiplicity of offensive play symbols and wherein at least one of said manually operable control elements transmits signals to said operational-circuit means to direct movements of said separate symbol to move it independently of said concurrently movable plurality of offensive play symbols.

8. The combination of claim 7 wherein said offensive-play-symbol-movement means includes means for advancing said ball-position symbol independently of the other offensive play symbols of said concurrently movable plurality thereof in a linear path along said simulated playing field to simulate a ball being passed, wherein said means for assigning prohibited moves permits coincidence of said ball-position symbol with at least said separate offensive play symbol during a simulated pass, and wherein said operational-circuit means further includes means for detecting the coincidence of said ball-position symbol and said separate offensive play symbol during a simulated pass to detect a simulated reception, said separate offensive play symbol thereby simulating a pass "receiver."

9. The combination of claim 7 wherein said prohibited moves assigned by said means for assigning prohibited moves include moves beyond said side boundary positions.

10. The combination of claim 2 wherein said means for assigning prohibited moves monitors the positions of more than one of said concurrently movable plurality of offensive play symbols, assigns prohibited moves thereto based on their monitored positions along said playing field, and prevents said prohibited moves of said more than one concurrently movable offensive play symbol by said offensive-play-symbol-movement means.

11. The combination of claim 10 wherein said means for assigning prohibited moves monitors the positions of all of said concurrently movable plurality of offensive play symbols, assigns prohibited moves thereto based on their monitored positions along said playing field, and prevents said prohibited moves thereof by said offensive-play-symbol-movement means.

12. The combination of claim 1 wherein the prohibited moves assigned by said means for assigning prohibited moves include moves to a position occupied by any other offensive play symbol of said concurrently movable plurality thereof.

13. The combination of claim 12 wherein said means for assigning prohibited moves monitors the positions of more than one of said concurrently movable plurality of offensive play symbols, assigns prohibited moves thereto based on their monitored positions along said playing field, and prevents said prohibited moves of said more than one concurrently movable offensive play symbol by said offensive-play-symbol-movement means.

14. The combination of claim 13 wherein said means for assigning prohibited moves monitors the positions of all of said concurrently movable plurality of offensive play symbols, assigns prohibited moves thereto based on their monitored positions along said playing field, and prevents said prohibited moves thereof by said offensive-play-symbol-movement means.

15. The combination of claim 1 wherein said means for assigning prohibited moves monitors the positions of more than one of said concurrently movable plurality of offensive play symbols, assigns prohibited moves thereto based on their monitored positions along said playing field, and prevents said prohibited moves of said more than one concurrently movable offensive play symbol by said offensive-play-symbol-movement means.

16. The combination of claim 15 wherein said means for assigning prohibited moves monitors the positions of all of said concurrently movable plurality of offensive play symbols, assigns prohibited moves thereto based on their monitored positions along said playing field, and prevents said prohibited moves thereof by said offensive-play-symbol-movement means.

17. The combination of claim 12, 14, or 15 wherein said multiplicity of offensive play symbols includes an offensive play symbol separate from said concurrently movable plurality thereof, wherein at least one of said manually operable control elements transmits signals to said operational-circuit means to direct moves of said separate offensive play symbol that are independent of the moves of said concurrently movable plurality of offensive play symbols, and wherein the moves prohibited by said means for assigning prohibited moves include moves to the position occupied by said separate offensive play symbol.

18. The combination of claim 17 wherein said prohibited moves assigned by said means for assigning prohibited moves include moves beyond said side boundary positions.

19. The combination of claim 12, 14, or 15 wherein said prohibited moves assigned by said means for assigning prohibited moves include moves beyond said side boundary positions.

20. The combination of claim 1 wherein the prohibited moves assigned by said means for assigning prohibited moves include moves to the position occupied by at least one symbol separate from said concurrently movable plurality.

21. The combination of claim 20 wherein said separate symbol is one of said multiplicity of offensive play symbols and wherein at least one of said manually operable control elements transmits signals to said operational-circuit means to direct movements of said separate symbol to move it independently of said concurrently movable plurality of offensive play symbols.

22. The combination of claim 21 wherein said offensive-play-symbol-movement means includes means for advancing said ball-position symbol independently of the other offensive play symbols of said concurrently movable plurality thereof in a linear path along said simulated playing field to simulate a ball being passed, wherein said means for assigning prohibited moves permits coincidence of said ball-position symbol with at least said separate offensive play symbol during a simulated pass, and wherein said operational-circuit means further includes means for detecting the coincidence of said ball-position symbol and said separate offensive play symbol during a simulated pass to detect a simulated reception, said separate offensive play symbol thereby simulating a pass "receiver."

23. The combination of claim 22 wherein said at least one manually operable control element for directing movements of said separate offensive play symbol is different from said at least one manually operable control element for directing movements of said concurrently movable plurality of offensive play symbols, said manually operable control elements for directing movements of said concurrently movable plurality and of said separate offensive play symbol being operable simultaneously to provide simultaneous manually controlled movement of said concurrently movable offensive play symbols and said separate offensive play symbol.

24. The combination of claim 21 wherein said at least one manually operable control element for directing movements of said separate offensive play symbol is different from said at least one manually operable control element for directing movements of said concurrently movable plurality of offensive play symbols, said manually operable control elements for directing movements of said concurrently movable plurality and of said separate offensive play symbol being operable simultaneously to provide simultaneous manually controlled movement of said concurrently movable offensive play symbols and said separate offensive play symbol.

25. The combination of claim 1, 2, 5, 20, 21, 22, 23, or 24 wherein said prohibited moves assigned by said means for assigning prohibited moves include moves beyond said side boundary positions.

26. The combination of claim 25 wherein the moves prevented by said means for assigning prohibited moves include moves beyond said boundary positions at one of said ends.

27. In a method of simulating a sports-action team game, the steps of:

a. providing a housing;

b. providing a display panel on the upper surface of said housing that provides a visual simulation of a playing field of the type on which a ball-type game is played and is adapted to display symbols in and between side and end boundary positions on said field in response to electrical signals applied thereto;

c. providing operational-circuit means in said housing operatively connected to said display panel for generation and transmission of electrical signals to said display panel to produce offensive and defensive play symbols on said simulated playing field, one of said offensive play symbols at a time simulating the position of the ball, said operational-circuit means step including:

(i) moving a multiplicity of said offensive play symbols, including said ball-position symbol, along said playing field, said multiplicity of offensive play symbols including a concurrently movable plurality thereof;

(ii) moving a multiplicity of said defensive play symbols along said playing field toward said ball-position symbol, movement of said offensive and defensive play symbols providing play action simulating the action of said sports-action team game;

(iii) detecting the coincidence of said ball-position symbol with at least a selected one of said defensive play symbols during at least a portion of a play and terminating play action upon such detection; and (iv) monitoring play action to record information concerning the status of said simulated game and for producing signals indicative of said status information, said signals conveying the recorded information to an operator of said game;

d. providing a control board on said housing that includes a multiplicity of manually operable control elements connecting said control board to said operational-circuit means for transmission of signals thereto through operation of said control elements, effecting movement of said ball-position symbol by said offensive-play-symbol-movement means in response to operation of said control elements by an operator to effect movement of said ball-position symbol through said defensive play symbols to simulate advance of the ball, terminating play action by said detecting means upon the occurrence of said game terminating coincidence;

e. monitoring the position of at least one of said concurrently movable plurality of offensive play symbols and assigning prohibited moves thereto based on its monitored position on said playing field;

f. operating at least one of said manually operable control elements to transmit signals to said operational-circuit means to direct the same move to each of said concurrently movable plurality of offensive play symbols, including a prohibited move to at least one of said concurrently movable plurality;

g. effecting all of the directed moves of said concurrently movable plurality except said at least one prohibited move, thereby changing the formation defined by the relative positions of said concurrently movable plurality;

h. operating at least one of said manually operable control elements to transmit signals to said operational-circuit means to direct a move of said concurrently movable plurality of offensive play symbols that is not prohibited to any of them; and i. effecting said last-mentioned directed moves of all of said concurrently movable plurality, thereby maintaining the new formation resulting from said first-mentioned effected moves.

28. In a method of simulating a sports-action team game, the steps of:

a. providing a housing;

b. providing a display panel on the upper surface of said housing that provides a visual simulation of a playing field of the type on which a ball-type game is played and adapted to display symbols in and between side and end boundary positions on said field in response to electrical signals applied thereto;

c. providing operational-circuit means in said housing operatively connected to said display panel for generation and transmission of electrical signals to said display panel to produce offensive and defensive play symbols on said simulated playing field, one of said offensive play symbols at a time simulating the position of the ball, said operational-circuit means step including:

(i) moving a multiplicity of said offensive play symbols, including said ball-position symbol, along said playing field, said multiplicity of offensive play symbols including a concurrently movable plurality thereof;

(ii) moving a multiplicity of said defensive play symbols along said playing field toward said ball-position symbol, movement of said offensive and defensive play symbols providing play action simulating the action of said sports-action team game;

(iii) detecting the coincidence of said ball-position symbol with at least a selected one of said defensive play symbols during at least a portion of a play and terminating play action upon such detection; and (iv) monitoring play action to record information concerning the status of said simulated game and for producing signals indicative of said status information, said signals conveying the recorded information to an operator of said game;

d. providing a control board on said housing that includes a multiplicity of manually operable control elements connecting said control board to said operational-circuit means for transmission of signals thereto through operation of said control elements, effecting movement of said ball-position symbol by said offensive-play-symbol-movement means in response to operation of said control elements by an operator to effect movement of said ball-position symbol through said defensive play symbols to simulate advance of the ball, terminating play action by said detecting means upon the occurrence of said game terminating coincidence;

e. arranging said concurrently movable plurality of offensive play symbols with at least one but not all of said concurrently movable plurality in one of said side and end boundary positions;

f. operating at least one of said manually operable control elements to transmit signals to said operational-circuit means to direct the same move to all of said concurrently movable plurality of play symbols, said same move being in the direction of said one of said end and side boundary positions, directing at least one of said offensive play symbols to move beyond said one of said end and side boundary positions;

g. effecting said directed move of all of said concurrently movable offensive play symbols except said at least one in said one of said side and end boundary positions, thereby changing the formation defined by the relative positions of said concurrently movable plurality of offensive play symbols to a new formation;

h. operating at least one of said manually operable control elements to transmit signals to said operational-circuit means to direct the same move of all of said concurrently movable plurality of offensive play symbols away from said one of said side and end boundary positions; and i. effecting said last-mentioned directed moves of all of said concurrently movable plurality of offensive play symbols, thereby maintaining said new formation.

29. In a method of simulating a sports-action team game, the steps of:

a. providing a housing;

b. providing a display panel on the upper surface of said housing that provides a visual simulation of a playing field of the type on which a ball-type game is played and adapted to display symbols in and between side and end boundary positions on said field in response to electrical signals applied thereto;

c. providing operational-circuit means in said housing operatively connected to said display panel for generation and transmission of electrical signals to said display panel to produce offensive and defensive play symbols on said simulated playing field, one of said offensive play symbols at a time simulating the position of the ball, said operational-circuit means step including:

(i) moving a multiplicity of said offensive play symbols, including said ball-position symbol, along said playing field, said multiplicity of offensive play symbols including a concurrently movable plurality thereof and at least one independent offensive play symbol;

(ii) moving a multiplicity of said defensive play symbols along said playing field toward said ball-position symbol, movement of said offensive and defensive play symbols providing play action simulating the action of said sports-action team game;

(iii) detecting the coincidence of said ball-position symbol with at least a selected one of said defensive play symbols during at least a portion of a play and terminating play action upon such detection; and (iv) monitoring play action to record information concerning the status of said simulated game and for producing signals indicative of said status information, and signals conveying the recorded information to an operator of said game;

d. providing a control board on said housing that includes a multiplicity of manually operable control elements, said control board being connected to said operational-circuit means for transmission of signals thereto through operation of said control elements, effecting movement of said ball-position symbol by said offensive-play-symbol-movement means in response to operation of said control elements by an operator to effect movement of said ball-position symbol through said defensive play symbols to simulate advance of the ball, terminating play action by said detecting means upon the occurrence of said game terminating coincidence;

e. arranging said offensive play symbols with said independent offensive play symbols adjacent at least one of said concurrently movable offensive play symbols;

f. operating at least one of said manually operable control elements to transmit signals to said operational-circuit means to direct the same move to all of said concurrently movable plurality of offensive play symbols, said directed moves including a move to the position of said independent offensive play symbol of said concurrently movable offensive play symbol adjacent said independent offensive play symbol;

g. effecting said directed moves of all of said offensive play symbols except said at least one adjacent said independent offensive play symbol, thereby providing a new formation defined by the relative positions of said concurrently movable plurality of offensive play symbols;

h. operating at least one of said manually operable control elements to transmit signals to said operational-circuit means to direct the same move of all said concurrently movable plurality of offensive play symbols, none of said last-mentioned directed moves being to the position of said independent offensive play symbol; and i. effecting said last-mentioned directed moves of all of said concurrently movable plurality of offensive play symbols, thereby maintaining said new formation thereof.

30. In an electronic apparatus for simulating a sports-action team game, the combination comprising:

a. a housing;

b. a display panel on the upper surface of said housing providing a visual simulation of a playing field of the type on which a game between opposing teams is played, said display panel having a multiplicity of discrete visual-image-producing devices arranged along x- and y-axes of said simulated playing field and adapted to display symbols representing players of opposing teams at a multiplicity of discrete positions along said x- and y-axes on said playing field in response to electrical signals transmitted thereto;

c. operational-circuit means in said housing operatively connected to said display panel for generation and transmission of electrical signals thereto to produce symbols of said opposing teams on said simulated playing field, at least one of said teams including at least first and second symbols;

(i) means for moving a multiplicity of said symbols of said one team along said playing field, said multiplicity of symbols including said first and second symbols;

(ii) means for moving a multiplicity of the symbols of the other team along said playing field toward one of said symbols of said first team, movement of said symbols of said two teams providing play action simulating the action of said sports-action team game; and (iii) means for monitoring the position of at least one of said symbols of said first team, means assigning prohibited moves thereto based on its monitored position on said playing field, and means for preventing said prohibited moves of said at least one symbol by said first team symbol movement means;

d. a control board on said housing including a multiplicity of manually operable control elements, said control board being electrically connected to said operational-circuit means for transmission of signals to said operational-circuit means through operation of said control elements, said control elements including first and second elongated levers, respectively, associated with said first and second symbols, said levers being pivotally mounted in said control board for pivoting from rest positions in which the longitudinal axes of said levers extend generally perpendicularly to the upper surface of said housing, said pivoting being along two pivotal axes extending generally perpendicularly to the longitudinal axes of said levers, said control board further including at least three switches associated with each of said levers along said pivotal axes thereof and electrically connected to said operational-circuit means for transmission of electrical signals thereto to direct movements of said symbol associated with each of said levers, pivoting of each of said levers along one pivotal axis in first and second directions operating the associated first and second switches to direct motion of the associated symbol in first and second directions, respectively, along one axis of said simulated playing field, pivoting of each of said levers in a first direction along the second pivotal axis thereof operating the associated third switch to direct motion of the associated symbol in a first direction along the other of said axes of said playing field, each actuation of a switch causing only one step of motion of the associated symbol, each lever and its associated switches being cooperatively configured and dimensioned and each lever being pivotally mounted to permit operation of only one switch at a time by each lever.

31. The electronic apparatus of claim 30 wherein said operational-circuit means also generates and transmits electrical signals to said display panel to produce first and second symbols of the other of said teams on said simulated playing field and wherein said apparatus further includes a second control board on said housing including a multiplicity of manually operable control elements, said second control board being electrically connected to said operational-circuit means for transmission of signals to said operational-circuit means through operation of said control elements of said second control board, said control elements including first and second elongated levers, respectively, associated with said first and second symbols of said other team, said levers of said second control board being pivotally mounted in said second control board for pivoting from rest positions in which their longitudinal axes extend generally perpendicularly to the upper surface of said housing, said pivoting being along two pivotal axes extending generally perpendicularly to the longitudinal axes of said levers, said second control board further including at least three switches associated with each of said levers of said second control board along said pivotal axes thereof and electrically connected to said operational-circuit means for transmission of electrical signals thereto to direct movements of said symbols associated with said levers of said second control board, pivoting of each of said levers of said second control board along one pivotal axis in first and second directions operating its associated first and second switches to direct motion of the associated symbol in first and second directions, respectively, along said one axis of said simulated playing field, pivoting of each of said levers in a first direction along the second pivotal axis thereof operating its associated third switch to direct motion of its associated symbol in a first direction along said other axis of said playing field, each actuation of a switch causing only one step of motion of the associated symbol, said switches and levers being cooperatively configured and dimensioned and said levers being pivotally mounted to permit operation of only one switch at a time by each lever.

32. The apparatus of claim 30 or 31 wherein each control board includes a fourth switch associated with each lever, pivoting of each of said levers in a second direction along the second pivotal axis thereof operating the associated fourth switch to direct motion of the associated symbol in a second direction along said other axis of said playing field.

* * * * *